US005937580A

United States Patent [19]

Bäckman

[11] Patent Number: 5,937,580

[45] Date of Patent: Aug. 17, 1999

[54] POWER TRANSMITTING DEVICE FOR DOORS AND THE LIKE

[75] Inventor: Eric Bäckman, Landskrona, Sweden

[73] Assignee: Entre-Matic AB, Sweden

[21] Appl. No.: 08/860,976

[22] PCT Filed: Jan. 18, 1996

[86] PCT No.: PCT/SE96/00038

§ 371 Date: Jul. 15, 1997

§ 102(e) Date: Jul. 15, 1997

[87] PCT Pub. No.: WO96/22444

PCT Pub. Date: Jul. 25, 1996

[30] Foreign Application Priority Data

Jan. 18, 1995 [SE] Sweden ..... 9500154

[51] Int. Cl.[6] ..... E05D 15/02

[52] U.S. Cl. ..... 49/43; 49/42

[58] Field of Search ..... 49/41–43, 46; 188/74, 82.1, 85.3, 82.34, 82.77, 84, 80, 83

[56] References Cited

U.S. PATENT DOCUMENTS 3,766,686 10/1973 Sheckells .
3,968,595 7/1976 Sheckells .
4,669,686 6/1987 Huber et al. ..... 188/80 X
4,872,285 10/1989 Applemann ..... 49/42
4,976,065 12/1990 Beran et al. .

FOREIGN PATENT DOCUMENTS

WO 92/08868 of 0000 WIPO .

*Primary Examiner*—Daniel P. Stodola
*Assistant Examiner*—Hugh B. Thompson
*Attorney, Agent, or Firm*—Ware, Fressola, Van der Sluys & Adolphson LLP

[57] ABSTRACT

A power transmitting arrangement for doors, preferably revolving or swinging doors with door leaves (30) moving in a circular path inside lateral portions (33), is useful for both driving and braking the door. Between a stationary element (K1) and a relatively displaceable element (K2) is arranged a power transmission including an engagement surface (Y) at the one element and at least one engagement device (18,23) at the other element wherein power such as motor power for the operation of the door and/or inertia derived from the door on the braking of the same is transmitted utilizing at least one obliquely against the surface of engagement (Y) arranged and such engagement device carrying swingably arranged arm so movable that the power engagement increases with increasing torque.

14 Claims, 6 Drawing Sheets

POWER TRANSMITTING DEVICE FOR DOORS AND THE LIKE

TECHNICAL FIELD OF THE INVENTION

This invention relates to a power transmitting device for mechanically controlled doors and the like having a stationary part and a part displaceable relatively to the stationary part especially for revolving door of so called round-about type and similar constructions, namely doors and similar partitions wherein two or more often three door leaves or the like extend essentially radially from a central frame towards curved partitions in order to, during the movement of the frame and the door leaves extending therefrom around a central axis of the frame, define movable passage spaces moving from one side of the door to the other. The invention relates also to such devices utilized for other types of doors, gates, partitions and the like movable along a straight or curved path.

BACKGROUND OF THE INVENTION

For the operating of doors of above and similar kind up till now different solutions have been used. As an example may be mentioned power or motor devices which over appropriate transmission arrangements by means of belt or chain drives move the door and motor driven rollers which with constant force are pressed against a running path at the door so that they on rotation moves the door.

Known arrangements are because of their construction rather rigid and have small, in many cases no ability to give way and allow manual moving of the doors for instance on loss of electric power. For such reasons it occurs that you have to arrange special emergency operating devices so that the doors will not be blocked on interruption of electricity supply.

Doors of the kind mentioned above, both rotating and sliding ones, also require some sort of braking device in order to stop the movement of the door. At known operating devices the braking effect often is achieved in inductive way by short circuiting the driving motor or in a similar way.

PURPOSE OF THE INVENTION

One aspect of the invention is to bring about a new operating device which can be used both on driving and on braking of doors and the like of the kinds mentioned, wherein the device both provides a better function and makes it possible to simplify the construction and reduce the number of necessary components and on top of that includes an automatic safety function.

Another aspect is to bring about a new power transmission device having an automatic control and adjusting of the transmission means in relation to transmitted torque.

SUMMARY OF THE INVENTION

The novelty of the invention lies in the invention of the devices which transmit driving power and braking power and it is characterized by that adjacent a surface forming an engagement path and being the power transmitting element of the one construction part there is mounted an engagement means forming the power transmitting element of the other construction part wherein the engagement means is carried by a pivotable arm so arranged and dimensioned that a set angle of friction is achieved resulting in an automatic engaging of the engagement means with the engagement path with a force varying in relation to the torque transmitted.

BRIEF DESCRIPTION OF THE DRAWINGS

The invention will be described in the following with references to the attached drawings, on which

Figure 1:
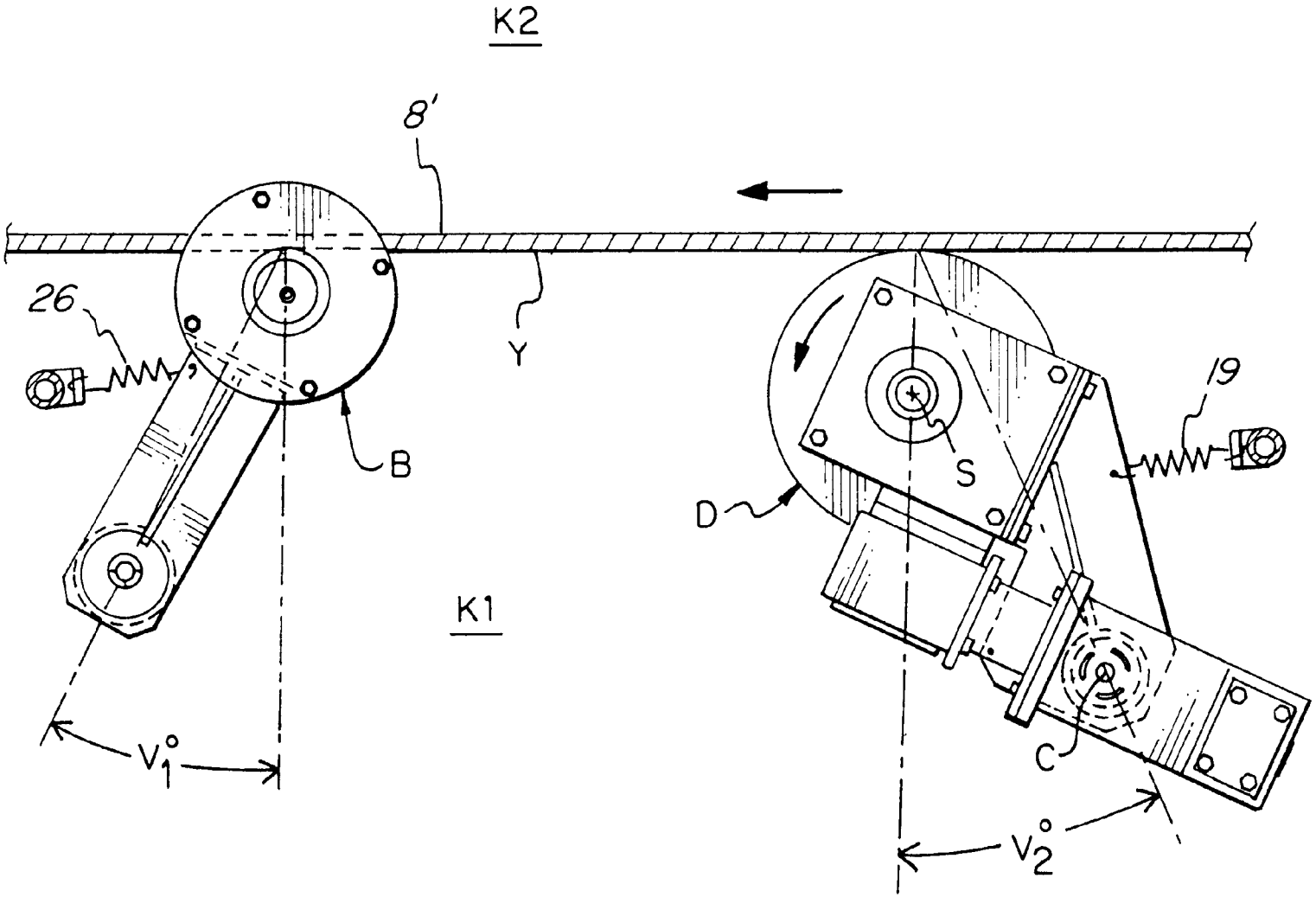
FIG. 1 is a top view of an embodiment illustrating the general principle of the power transmitting, driving and braking devices according to the invention, FIGS. 2 and 3 as a side view partly in section and top view, respectively, illustrate the general construction of a rotating door with a preferred embodiment of the device according to this invention, FIGS. 4 and 5 in a side view and a top view, respectively, and in an enlarged scale show broken out portions from FIGS. 2 and 3, FIGS. 6 and 7 in a side view and a top view, respectively, in still larger scale illustrate the driving device according to the invention, and FIGS. 8 and 9 in a side view and a top view, respectively, in the same scale as FIGS. 6 and 7 show the braking device according to the invention.

In the disclosed preferred embodiment where the device is adapted for a rotating door there is a frame 1 and the frame 1 includes bottom section 2 consisting of two metal sheets arranged at a distance from each other, a top section likewise consisting of two metal sheets arranged at a distance from each other and further three pillars 3 made of pipes or hollow profiles and adapted to each carry a door leaf 30. The corners of the sheets are welded to each pillar and the outwardly open spaces between the two lower and the two upper sheets respectively are closed by side pieces 4 also welded to the edge of each sheet. The two lower metal sheets 5 and 6 have aligned circular holes 7 and a cylindrical ring 8 is fitted into the two holes and welded to the edges of the holes.

The inwardly towards the center facing side of this cylindrical ring 8 fitted into the bottom section 2 is adapted to cooperate with and constitutes the engagement surface Y for the driving and braking devices, respectively, according to the invention and described in detail below.

The one part of a roller bearing 9 is attached to the lower sheet 6 of the bottom section and the other part of the roller bearing is via an intermediate ring secured to a base plate 10 secured to the foundation 11.

Before describing the preferred embodiment according to FIGS. 2–9 the general principles behind the invention will be explained in detail with reference to FIG. 1. A further purpose behind FIG. 1 is also to show that the invention by no means is limited to the embodiment shown in FIGS. 2–9 having a curved surface of engagement Y formed by cylindrical ring 8 but can also be used for operating doors and the like moving along straight paths and including a straight surface of engagement Y.

The basic elements are a first constructional element K1 not shown in the detail in FIG. 1 which can be a stationary foundation, a frame or the like and a second neither shown constructional element K2 which can be a door, gate or the like and which is to be movable relatively to the first element.

The two elements K1 and K2 of FIG. 1 are relatively movable along a linear path. At the one element there are driving and braking devices D and B, respectively, and at the other element there is an elongated constructional detail 8' comparable with the ring 8 mentioned before and having an engagement surface Y. The surface Y of the detail 8' or of the ring part 8 of element K2 together with the driving and braking devices D and B, respectively, of element K1 form the power transmitting parts between the two elements.

The driving and braking devices D and B, respectively, pivotably arranged relatively to fulcrums are arranged in such a way that they engage the surface Y in determined under opposite angles V1 and V2 resulting in creation of an intended power transmitting engagement. The function and interaction between the parts will appear from the following.

Figure 2:
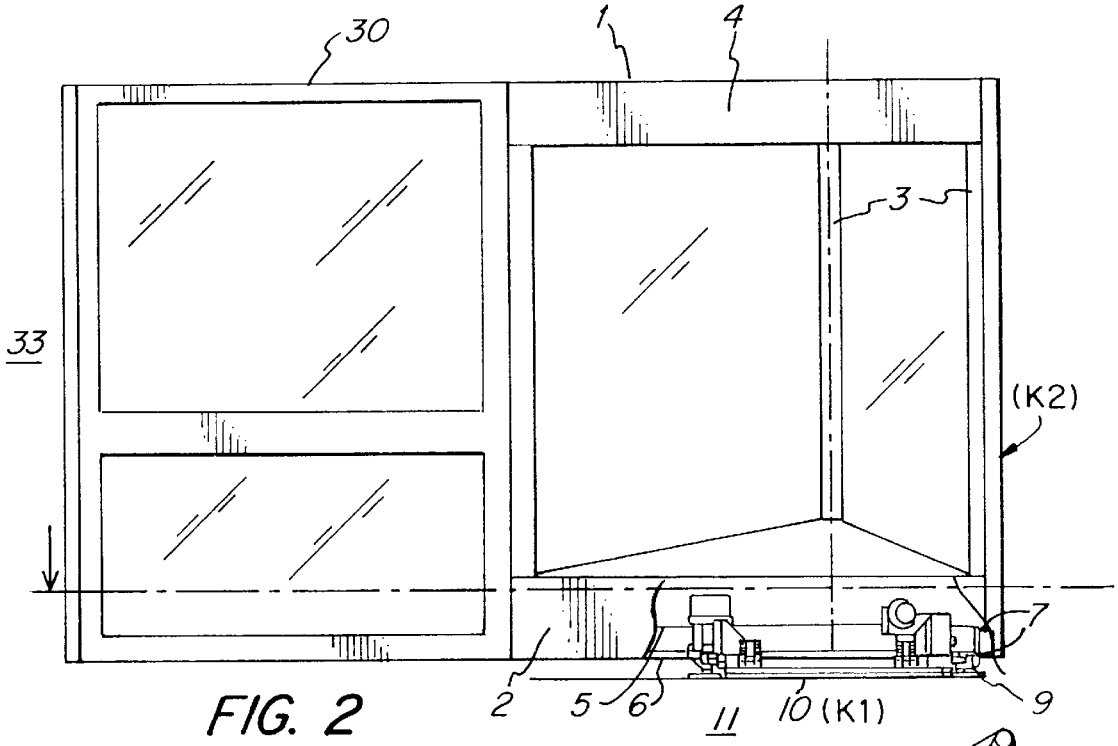
Figure 3:
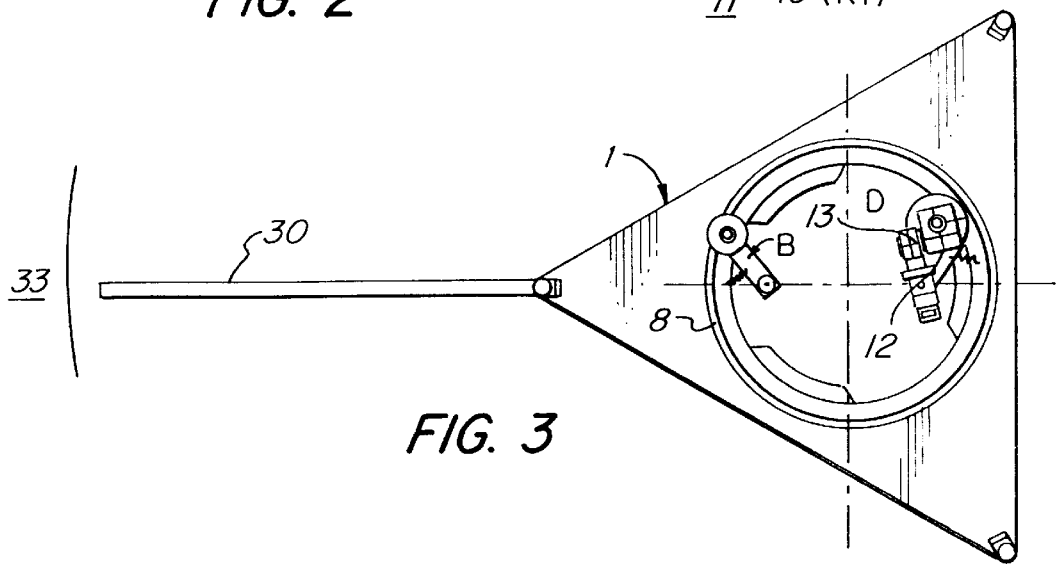
Figure 4:
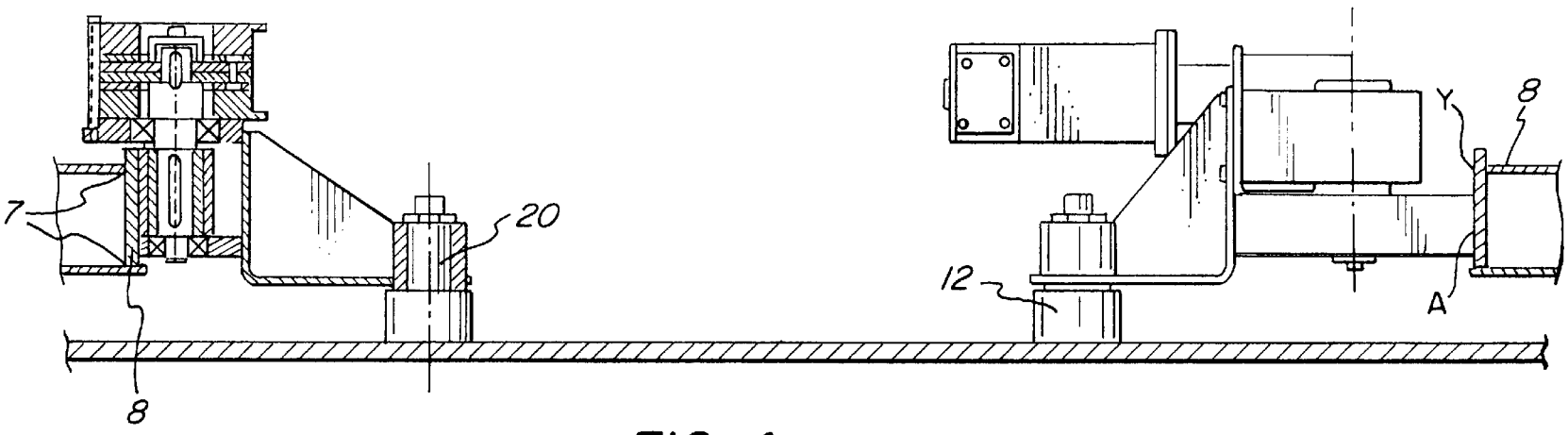
Figure 5:
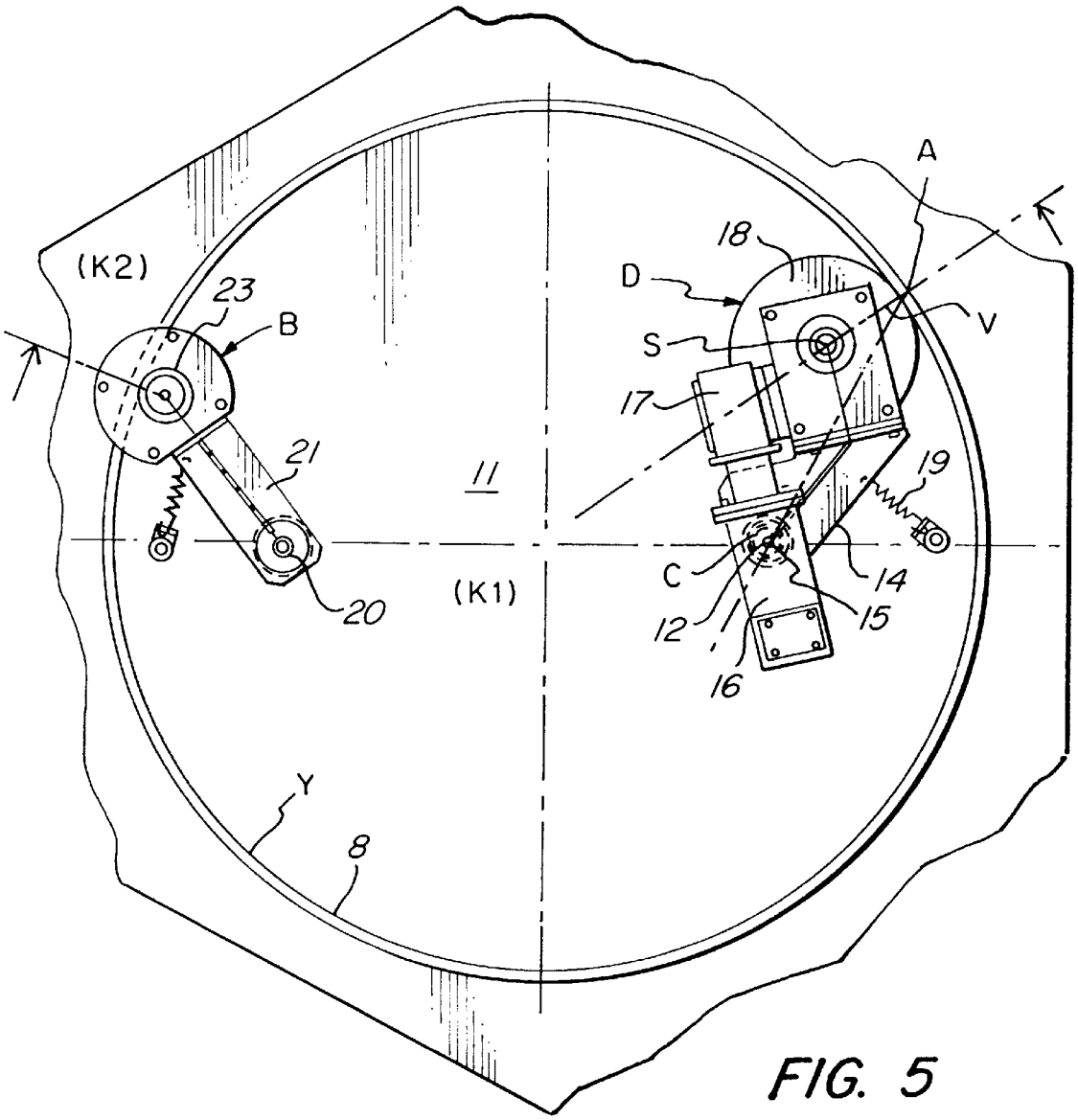
Figure 6:
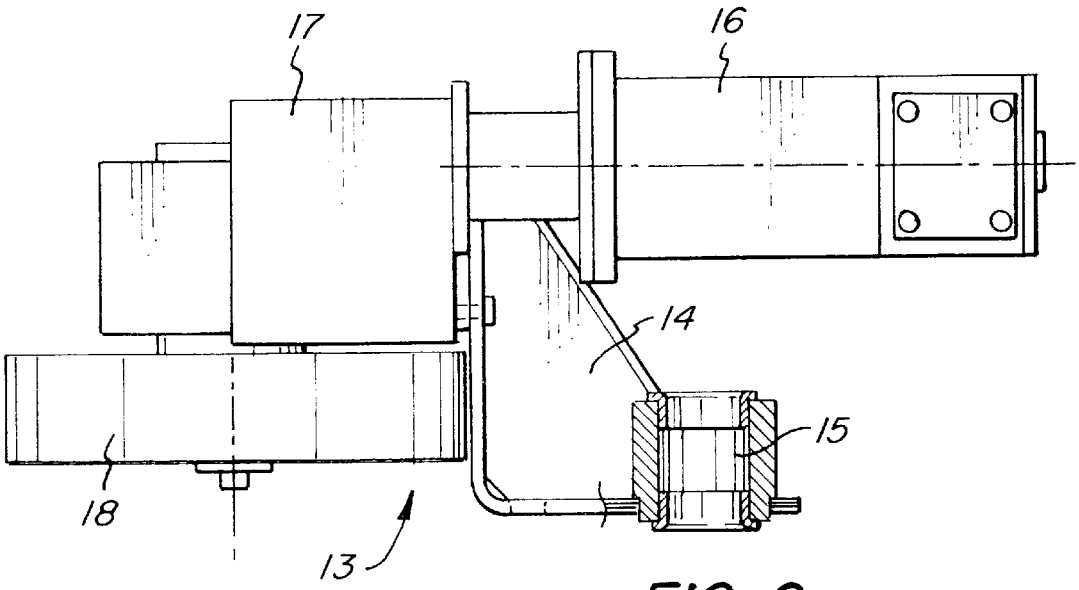
Figure 7:
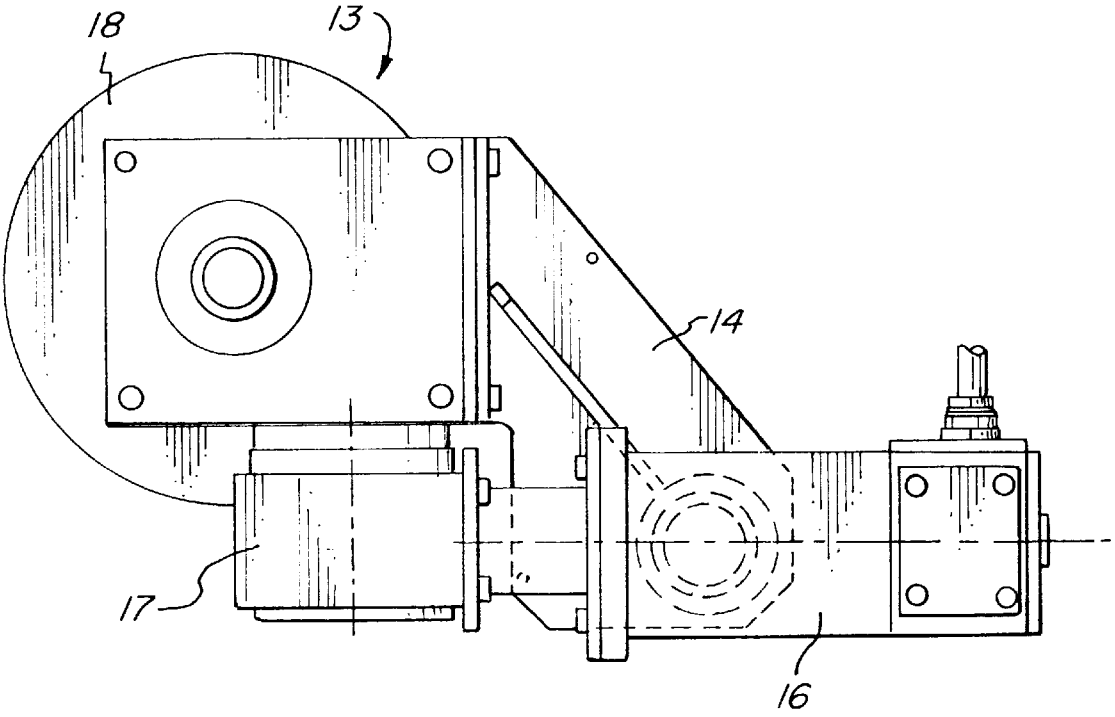
Figure 8:
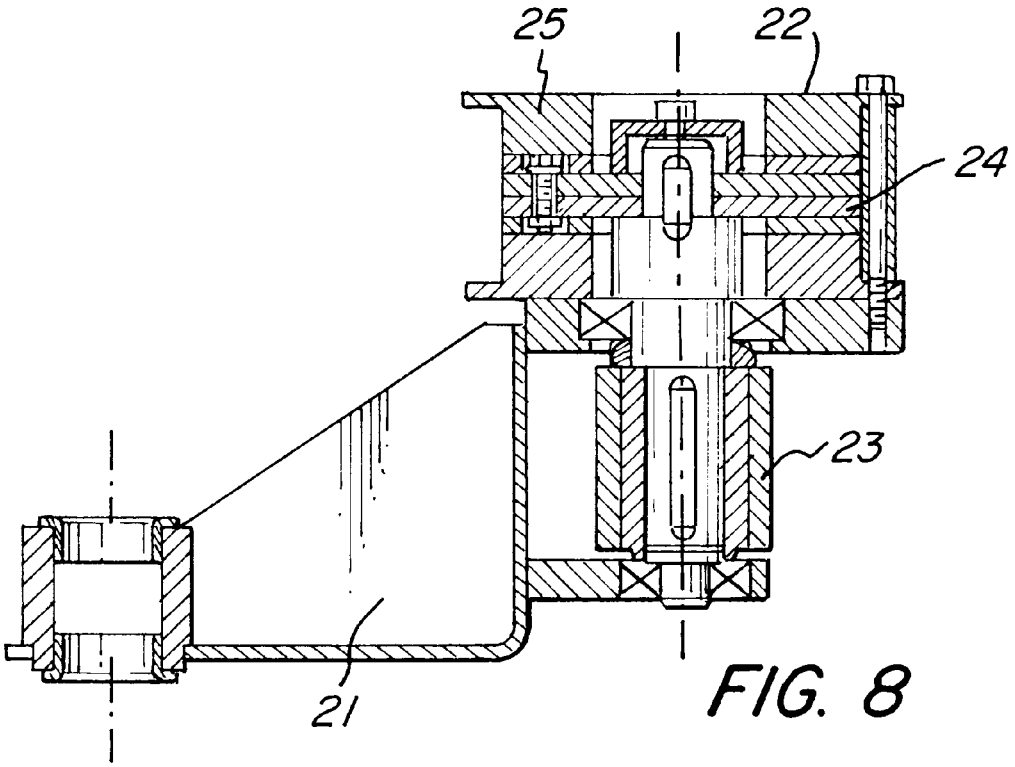
Figure 9:
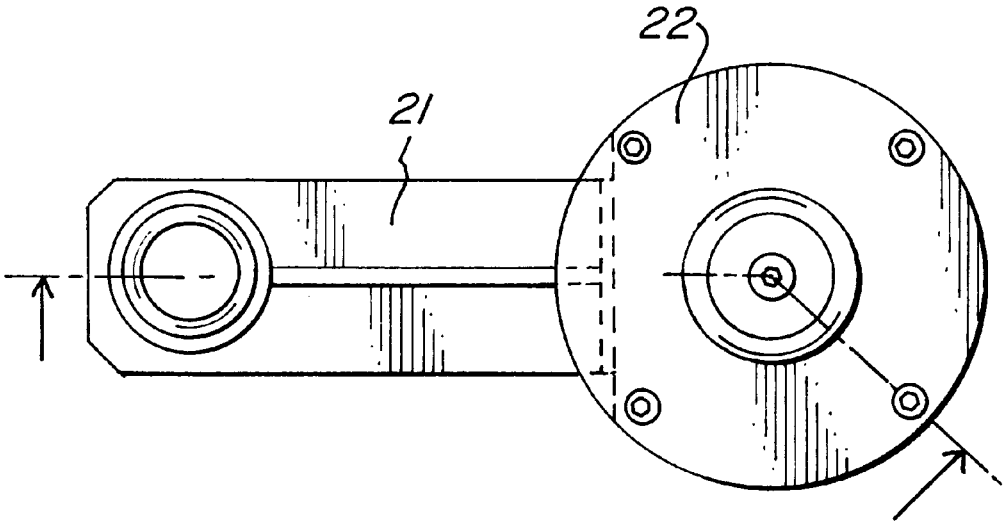

In the embodiment according to FIGS. 2, 3 and following the one element K1 is constituted by the base plate 11 mentioned before and belonging to the revolving door. At said base plate 11 is secured a first pivot pin 12 carrying the driving device D, in the following designated 13. The driving device D includes a bracket 14 provided with a bearing 15 adapted to the pivot pin 12 and seats for a motor 16, a worm gear 17 and a driving wheel 18 connected to the output shaft of the worm gear 17 and forming the actual engagement part of the driving device D.

The pivot pin 12 is so located that on rotating the driving wheel 18 by the motor 16, the wheel 18 pulls itself towards the surface Y of the inner side of the ring 8. In order to reach such an engagement the tangent for the angle of friction V, i.e. the angle between a line from the point of engagement A (FIG. 5) of driving wheel 18 and the center axis S of the wheel 18 and the point of engagement A of the wheel 18 and the pivot axis C of the driving device D at the pivot pin 12 smaller than the coefficient of friction between wheel 18 and surface or path. See also FIG. 1. If this relation exists, there will be an automatic engagement as soon as the motor 16 is activated.

As can be seen from the drawing and the above, the point of engagement A of the driving wheel 18 or engaging element with the surface Y of the path 8 is located, when seen in the direction of relative movement, beyond a point where a radius from the pivot axis C intersects the surface Y.

In order to secure a necessary initial engagement and in order to avoid accidental swinging of a stopped driving device D away from the surface of the path, a weak spring 19 is arranged to keep the wheel 18 lightly in engagement against the surface of the path. On starting the motor 16, the driving wheel 18 will pull itself towards and against the surface with a power increasing torque.

The light engagement existing when the driving motor 16 is unactivated results in an insignificant resistance against manual activation. It is possible to pass through the door by pushing the door leaves forward manually resulting in a turning of the frame and the whole door arrangement. The driving wheel 18 of the driving device then will slip lightly against the surface of the path with small resistance. This characteristic makes it possible to pass through the door also if an interruption of electrical power has taken place and is important from a safety point of view.

The fact that the driving device D or 13 is swingably or oscillatably carried by its pivot pin 12 allows for uneveness on the engagement surface. In the embodiment shown, it is of no importance if the ring 8 is slightly out of round as it has no impact on the function. It is not necessary to machine said surface to any higher degree of exactness which naturally reduces the manufacturing cost.

The base plate 11 carries one pivot pin 20 more and this swingably carries a second bracket device 21. The swingably mounted bracket device 21 carries a braking device B hereafter designated 22, including a braking roller 23 also constituting the engagement piece and the braking roller 23 is by means of a shaft rigidly connected with a braking disc 24 against which braking shoes or pads 25 may be pressed with a controllable force in order to counteract the rotation of the braking disc 24 and consequently the braking roller 23.

It may be mentioned that in this embodiment the intention is that the engagement piece or braking roller 23 during braking rolls against the surface Y of the ring 8 and that the kinetic energy to be reduced is caused to generate friction heat by the friction between the braking disc 24 and the braking shoes or pads 25. The braking disc 24 is normally not intended to be braked to standing still.

It may also be mentioned that in an alternative not shown embodiment the system including a rotating braking roller, a braking disc and braking shoes or pads is replaced by a braking shoe or pad arranged in a way geometrically similar way with that of the roller and in this case the braking shoe directly serves as engagement part in directly engaging the surface Y of the ring 8. On engagement with the surface Y, the braking shoe will automatically be pressed harder and harder against the surface in relation to an increasing torque and thus generate an increasing braking power.

The bracket means 21 is so arranged in relation to the radial distance between the pivot pin 20 and the surface Y at the inside of the ring 8 that the brake roller 23 after following the swinging of the bracket 21 towards the ring 8 will touch its face— seen in the direction of relative movement—in front of the point where a radius from the pivot pin 20 intersects the ring 8. On activating the brake the roller 23, rolling against the surface Y of the ring 8 will cause a transmission of power this time in a direction from the ring surface Y to the roller 23 whereas in the driving wheel case the transmission takes place in the opposite direction from the driving wheel 18 to the ring surface Y. In order to reach the intended self regulating engagement here also, as in the driving arrangement, it is a requirement that the angle V of friction between a line from the point of engagement of the braking roll 23 at the ring surface Y to the axis of the pivot pin 20 and one from the same point of engagement running radius against the axis of the roll 23 be less than the coefficient of friction between the roll 23 and the surface Y. The power transmitted is essentially equal to the torque transmitted from the surface Y to the roller 23 on its essentially slip free rolling and is further transmitted to the braking disc 24 and transformed into heat between said disc 24 and the brake pads 25. By the described arrangement the braking apparatus will be self adjusting so that on a weak braking the engagement pressure is low whereas on hard braking the pressure will be high. The intention is as already said that the roller 23 all the time rolls against the surface and this is possible thanks to the fact that the braking roller will be pressed against the surface of the ring 8 with a varying power depending on how hard the pads 25 are pressed against the braking disc 24. If the rotatable roller 23 is replaced with a braking shoe or pad having an appropriate friction generating surface it will be found that also here the pressure of engagement against the surface will increase on heavier braking. The embodiment including a roller is however preferred, especially on constructions where the driving arrangement has a transmission of self blocking type where reverse motion is impossible. If the alternative including a braking shoe arrangement was combined with a driving arrangement including a transmission of self blocking type, it might occur, on heavy braking, that the arm by the tangential force resultant is brought along so far that it is will become seized in a braking position. If the driving arrangement is of self locking type, also the door as a whole might be blocked as the reverse movement necessary to release the arm cannot be reached. On reduction of braking power the power transmission between the surface of engagement Y and the roller 23 will be reduced, in relation to reduction of the pressure of engagement, to the vicinity of zero. As with the driving arrangement the function necessitates an initial engagement and this is generated by means of a weak spring 26 making the roller 23 to roll against the surface Y with a slight pressure as long as the braking disc and the braking pads are inactive.

In an embodiment where the roll is replaced by a braking shoe or pad the shoe or pad naturally must not be allowed to slip against the ring 8 surface Y as it in such a case would be carried along and cause braking. In order to keep the necessary gap between the braking shoe and the surface Y the braking shoe arm is provided with one or several wheels rolling against the surface and keeping the shoe at an appropriate distance from the surface. On braking the arm carrying the shoe is swung against the surface Y whereupon the wheels will flex or other-wise give away so that the friction surface of the shoe will engage the opposite surface Y of the ring 8.

I claim:

1. Power transmission arrangement for mechanically operated doors, the arrangement comprising:

(a) relatively displaceable first and second elements, the second element having a surface of engagement;

(b) at least one power transmission device arranged for transmitting power from a power source in order to control relative movement between the first and second elements, the power transmission device includes at least one engagement part arranged to frictionally engage the surface of engagement at a point of engagement and having a coefficient of friction therebetween, the at least one engagement part arranged on a carrying arm and movable towards and away from the surface of engagement, and the carrying arm pivotably arranged around a pivot axis parallel with the surface of engagement and having an angle of friction in relation to the pivot axis and the surface of engagement such that a tangent of the angle of friction is smaller than the coefficient of friction between the at least one engagement part and the surface of engagement, so an automatic engaging results between the at least one engagement part and the surface of engagement with a force varying in relation to transmitted torque.

2. Arrangement according to claim 1, wherein the angle of friction is an angle between an imaginary line normal to the surface of engagement extending from the point of engagement and an imaginary line between the point of engagement and the pivot axis.

3. Arrangement according to claim 1, wherein the angle of friction is an angle between an imaginary line extending along a radius of the surface of engagement from the point of engagement and an imaginary line between the point of engagement and the pivot axis.

4. Arrangement according to claim 1, wherein the second element includes a rotatable frame having at least one radially arranged door leaf extending therefrom, the at least one radially arranged door leaf for cooperation with curved partition in a wall of the first element.

5. Arrangement according to claim 1, wherein the power source is kinetic energy of the second element transmitted from the surface of engagement to the at least one engagement part carried by the carrying arm for subsequent transforming into heat.

6. Arrangement according to claim 5, wherein the at least one engagement part is a rotatable roller carried by the carrying arm and engaged for rolling against the surface of engagement and connected to a braking means, which, during transformation of the kinetic energy to heat, counteracts movement of the roller and also movement of the surface of engagement.

7. Arrangement according to claim 5, wherein the at least one engagement part includes braking means having a rotatable roller provided with a friction surface and rigidly connected with a braking device and together therewith carried by the carrying arm, the carrying arm being arranged so that on activating of the braking means, the rotatable roller rolling relatively to the surface of engagement is pressed against the surface of engagement with a force increasing with increasing torque.

8. Arrangement according to claim 1, wherein the at least one engagement part is a braking means directly engaging the surface of the engagement and for transforming kinetic energy thereof to friction heat thereby counteracting relative movement between the first and second elements carrying the braking means and the surface of engagement, respectively.

9. Arrangement according to claim 8, wherein the braking means is a braking shoe provided with a friction surface carried by a swingably arranged arm so obliquely arranged relative to the surface of engagement so that the brake means will be self engaging upon actuation.

10. Arrangement according to claim 9, wherein the braking shoe is provided with displaceably arranged rolling means for keeping the braking shoe remote from the surface of engagement in an unactivated state of the braking shoe but allowing direct engagement between the braking shoe and the surface of engagement in the activated state of the braking shoe.

11. Power transmitting arrangement for mechanically operated doors, the arrangement comprising:

(a) relatively displaceable first and second elements, the second element having a surface of engagement;

(b) at least one power transmission device arranged for transmitting power from a power source in order to control relative movement between the first and second elements, the power transmission device includes at least one engagement part arranged to frictionally engage the surface of engagement at a point of engagement and having a coefficient of friction therebetween, the at least one engagement part arranged on a carrying arm and movable towards and away from the surface of engagement, and the carrying arm pivotably arranged around a pivot axis parallel with the surface of engagement and having an angle of friction in relation to the pivot axis and the surface of engagement such that a tangent of the angle of friction is smaller than the coefficient of friction between the at least one engagement part and the surface of engagement, wherein the power source is arranged at the first element and includes a drive motor with an appropriate transmission, the at least one engagement part is a wheel driven by the motor and carried by the carrying arm and arranged to engage the surface of engagement of the second element at the point of engagement and the carrying arm is arranged such that the point of engagement trails a point on the surface of engagement where an imaginary line through the pivot axis of the carrying arm along a radius of the surface of engagement intersects the surface of engagement as viewed from a direction of relative movement between the first and second elements.

12. Power transmission arrangement for mechanically operated doors, the arrangement comprising:

(a) relatively displaceable first and second elements, the second element having a surface of engagement;

(b) at least one power transmission device arranged for transmitting power from a power source in order to control relative movement between the first and second elements, the power transmission device includes at least one engagement part arranged to frictionally engage the surface of engagement at a point of engagement and having a coefficient of friction therebetween, the at least one engagement part arranged on a carrying arm and movable towards and away from the surface of engagement, and the carrying arm pivotably arranged around a pivot axis parallel with the surface of engagement and having an angle of friction in relation to the pivot axis and the surface of engagement such that a tangent of the angle of friction is smaller than the coefficient of friction between the at least one engagement part and the surface of engagement, wherein the at least one power transmission device has driving means mounted on the first element inside a rotatable frame forming the second element, said driving means includes a wheel and a drive motor forming the at least one engagement part arranged to cooperate with the surface of engagement, the surface of engagement being constituted by an inner face of an annular peripherally arranged element rigidly connected to said frame, the at least one power transmission device also includes a braking means arranged to cooperate with the surface of engagement and having engagement means swingably arranged on an arm for swinging towards and away from the surface of engagement and both said driving and braking means are so arranged that self engaging effect is achieved.

13. Arrangement according to claim 12, wherein said rotatable frame has at least one radially arranged door leaf extending therefrom, the at least one radially arranged door leaf for cooperation with curved partition in a wall of the first element.

14. Power transmission arrangement for mechanically operated doors, the arrangement comprising:

(a) relatively displaceable first and second elements, the second element having a surface of engagement, the surface of engagement is an inner surface of a ring rigidly connected to the second element; and (b) at least one power transmission device arranged for transmitting power from a power source in order to control relative movement between the first and second elements, the power transmission device includes at least one engagement part arranged to frictionally engage the surface of engagement at a point of engagement and having a coefficient of friction therebetween, the at least one engagement part arranged on a carrying arm and movable towards and away from the surface of engagement, and the carrying arm pivotably arranged around a pivot axis parallel with the surface of engagement and having an angle of friction in relation to the pivot axis and the surface of engagement such that a tangent of the angle of friction is smaller than the coefficient of friction between the at least one engagement part and the surface of engagement, wherein the power transmission device is supported on the first element which also supports the second element.

* * * * *